US010441064B2

(12) United States Patent
Watkins

(10) Patent No.: US 10,441,064 B2
(45) Date of Patent: Oct. 15, 2019

(54) CELL PHONE CASE HAVING AN INTERCHANGEABLE BRACELET

(71) Applicant: Brynne M. Watkins, Valley City, OH (US)

(72) Inventor: Brynne M. Watkins, Valley City, OH (US)

( * ) Notice: Subject to any disclaimer, the term of this patent is extended or adjusted under 35 U.S.C. 154(b) by 0 days.

(21) Appl. No.: 15/652,142

(22) Filed: Jul. 17, 2017

(65) Prior Publication Data

US 2018/0014630 A1 Jan. 18, 2018

Related U.S. Application Data

(60) Provisional application No. 62/363,772, filed on Jul. 18, 2016.

(51) Int. Cl.
*A45F 5/00* (2006.01)
*A44C 5/00* (2006.01)
*A45C 11/00* (2006.01)

(52) U.S. Cl.
CPC ..... *A45F 5/00* (2013.01); *A44C 5/0007* (2013.01); *A44C 5/0053* (2013.01); *A44C 5/0084* (2013.01); *A45C 11/00* (2013.01); *A45F 2005/008* (2013.01); *A45F 2200/0516* (2013.01)

(58) Field of Classification Search
CPC ..... F16M 13/04; F16M 11/041; F16M 11/06; A45F 2005/008; A45F 2200/0525; A45F 5/00; A45F 2200/0516; A44C 5/0053; A44C 5/0084; A44C 5/0007; A45C 11/00
USPC ..... 224/219, 217, 218, 164–180; 361/679.59
See application file for complete search history.

(56) References Cited

U.S. PATENT DOCUMENTS

2003/0213886 A1* 11/2003 Gilbert ..... A47B 23/044 248/454
2010/0222118 A1* 9/2010 Interdanato ..... H04B 1/385 455/575.6
2012/0031937 A1* 2/2012 Baker ..... A45C 11/00 224/217
2012/0188693 A1* 7/2012 Chiang ..... F16M 11/10 361/679.01
2014/0084034 A1* 3/2014 Wangercyn, Jr. ..... H04B 1/385 224/217
2014/0299488 A1* 10/2014 Andrew ..... A45C 13/002 206/37
2014/0364176 A1* 12/2014 Pintor ..... H04B 1/385 455/575.6

* cited by examiner

*Primary Examiner* — Nathan J Newhouse
*Assistant Examiner* — Matthew T Theis

(57) ABSTRACT

The present invention relates to various cell phone cases that are designed to include one or more interchangeable bracelet elements. In one embodiment, the cell phone case of the present invention is comprised of a phone case element designed to hold a cell phone and/or provide protection to a cell phone and a coupling portion that is operatively located on the backside of the phone case element, where the coupling portion of the present invention is designed to engage at least one or more interchangeable bracelet elements (the bracelet elements being designed to be worn around a user's wrist and/or forearm).

15 Claims, 3 Drawing Sheets

CELL PHONE CASE HAVING AN INTERCHANGEABLE BRACELET

RELATED APPLICATION DATA

This application claims priority to and is a non-provisional of U.S. Provisional Patent Application No. 62/363,772 filed Jul. 18, 2016 and entitled "Cell Phone Case Having an Interchangeable Bracelet," the disclosures of which is hereby incorporated herein by reference in its entirety.

FIELD OF THE INVENTION

The present invention relates to various cell phone cases that are designed to include one or more interchangeable bracelet elements. In one embodiment, the cell phone case of the present invention is comprised of a phone case element designed to hold a cell phone and/or provide protection to a cell phone and a coupling portion that is operatively located on the backside of the phone case element, where the coupling portion of the present invention is designed to engage at least one or more interchangeable bracelet elements (the bracelet elements being designed to be worn around a user's wrist and/or forearm).

BACKGROUND OF THE INVENTION

Women, as well as some men, almost always have their cell phones on their person. After all, people now use their cell phones for a wide range of functions beyond just making calls. Given this, finding a place to put one's cell phone while out and about presents numerous problems. Women, in particular, have a hard time finding a place to put their cell phone. This is especially true if a woman is not carrying a purse, is working out, or is partaking in some other activity.

While there are numerous activity-related cell phone cases, these cases generally locate one's cell phone on the upper portion of a user's arm, are not fashionably designed, and/or are too bulky for use in connection with everyday non-exercise-related activities.

Thus, there is a need in the art for a cell phone case that is both fashionable (this is especially true for women users) and is easy to wear and use when not partaking in exercise-related and/or sports-related activities.

SUMMARY OF THE INVENTION

The present invention relates to various cell phone cases that are designed to include one or more interchangeable bracelet elements. In one embodiment, the cell phone case of the present invention is comprised of a phone case element designed to hold a cell phone and/or provide protection to a cell phone and a coupling portion that is operatively located on the backside of the phone case element, where the coupling portion of the present invention is designed to engage at least one or more interchangeable bracelet elements (the bracelet elements being designed to be worn around a user's wrist and/or forearm).

DETAILED DESCRIPTION OF THE INVENTION AND THE FIGURES

The present invention relates to various cell phone cases that are designed to include one or more interchangeable bracelet elements. In one embodiment, the cell phone case of the present invention is comprised of a phone case element designed to hold a cell phone and/or provide protection to a cell phone and a coupling portion that is operatively located on the backside of the phone case element, where the coupling portion of the present invention is designed to engage at least one or more interchangeable bracelet elements (the bracelet elements being designed to be worn around a user's wrist and/or forearm).

Figure 1:
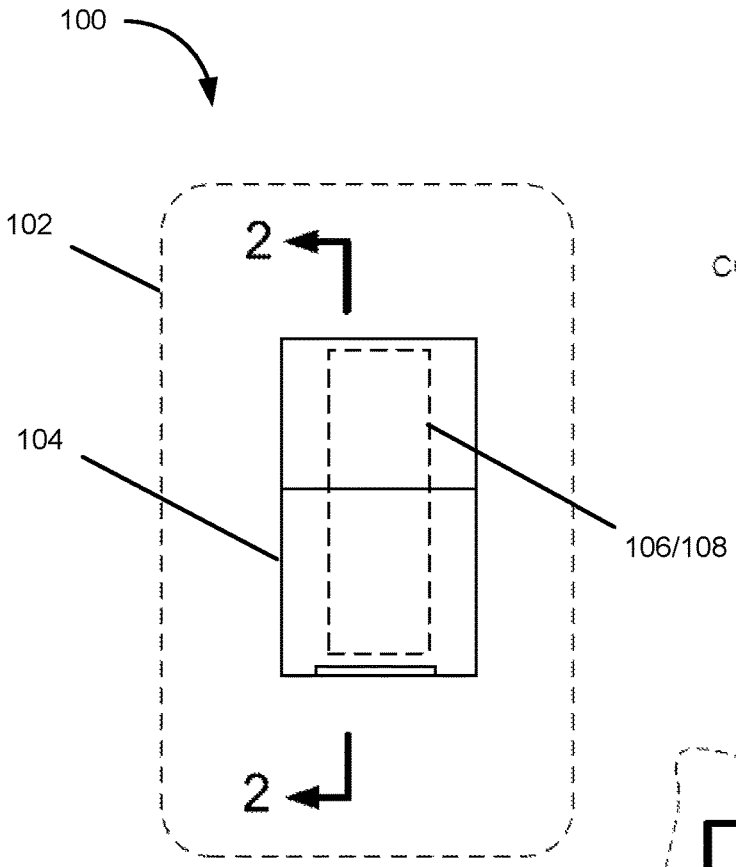
FIG. 1 is a bottom view of a cell phone case according to one embodiment of the present invention.

Turning to FIGS. 1 through 4, as illustrated therein these Figures illustrate a cell phone case 100 according to one embodiment of the present invention where such a cell phone case is comprised of a phone case element 102 (shown in dashed lines in FIG. 1) and a coupling portion 104 that is operatively located on the backside of the phone case element that is illustrated as a rectangular portion located between the 2-2 arrows of FIG. 1. It should be noted that in FIGS. 1 through 4, cell phone case 100 is illustrated with only a partial piece 106 of an overall bracelet element 108 shown therein. For a fuller illustration of the nature of bracelet element 108, one should see FIGS. 5 and 6.

In one embodiment, coupling portion 104 of cell phone case 100 of the present invention can be integrally formed together with the material used to form phone case element 102 of cell phone case 104 of the present invention. In another instance, coupling portion 104 and phone case element 102 of cell phone case 100 of the present invention can be formed separately and joined together by any suitable manner including, but not limited to, glue, ultrasonic welding, adhesive, etc. As would be apparent to those of skill in the art, the material used to form phone case element 102 of cell phone case 100 of the present invention can be any suitable material selected from wood, metal, or any suitable polymer or plastic material, or any combination of any two or more thereof.

Figure 5:
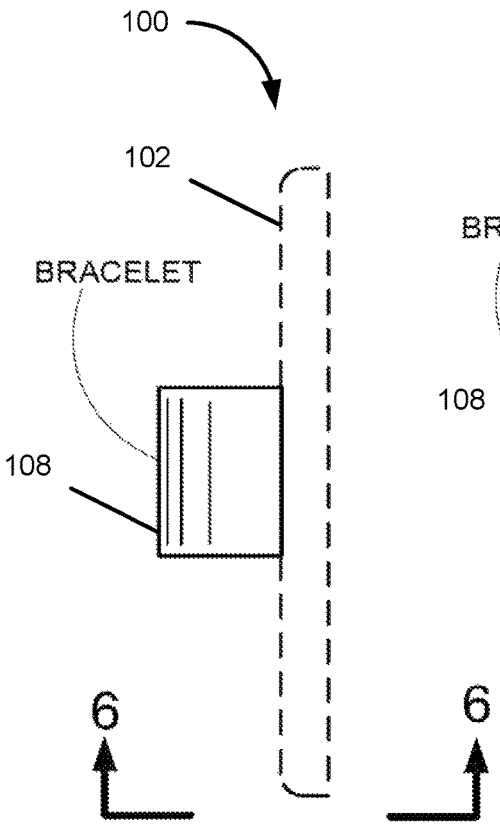
FIG. 5 is a side view illustration of a cell phone case according to one embodiment of the present invention with a bracelet element attached via the coupling portion of the present invention.
Figure 6:
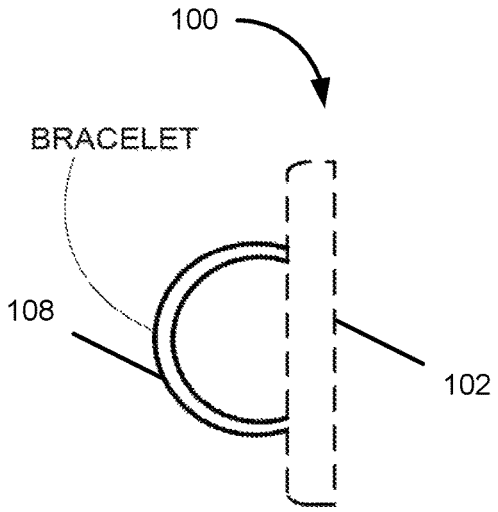
FIG. 6 is an end view illustration of the cell phone case, bracelet element and coupling portion of FIG. 5 along the 6-6 lines of FIG. 5.

Turning to the smaller dashed rectangle located within coupling portion 104, rectangle 106 represents a partial piece of bracelet element 108 (not completely shown—see FIGS. 5 and 6 for a fuller detailed view of bracelet element 108 according to one embodiment of the present invention). In one embodiment, bracelet element 108 in accordance with one embodiment of the present invention can be formed from any suitable material including, but not limited to, any fabric material, any polymer fabric material, any elastomeric or stretchable material, etc. As can be seen from FIG. 2, the backside of phone case element 102 of cell phone case 100 together with coupling portion 104 acts to capture, couple and/or engage a partial part 106 of bracelet element 108 of the present invention's cell phone case. Due to this capture, which can be disengaged and/or decoupled as desired by a user, cell phone case 100 of the present invention permits a user to interchange the bracelet element 108 of cell phone case 100 as desired with one or more other alternative bracelet elements 108 (not shown). This feature of the present invention permits a user to alter the appearance and/or functionality of a cell phone case in accordance with the present invention.

While the various features of the present invention are shown as generally rectangular in shape, one of skill in the art will recognize that the present invention is not limited to any one geometric shape. As such, the any combination of geometric shapes can be utilized to form the various features of the present invention. Such geometric shapes can in part be dictated by the model of cell phone for which the cell phone case of the present invention is designed to work with.

Figure 2:
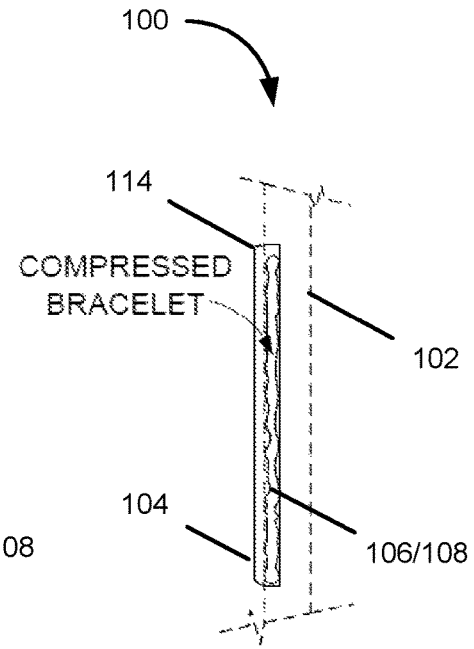
FIG. 2 is a side view illustration of the cell phone case of FIG. 1 along the 2-2 lines of FIG. 1.
Figure 4:
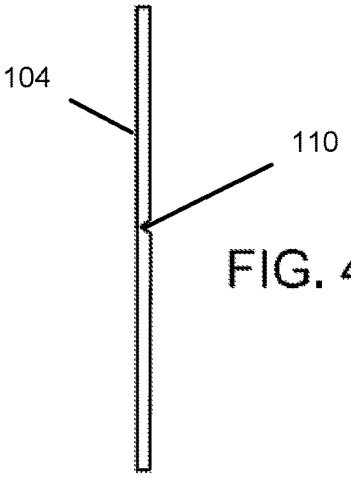
FIG. 4 is a side view illustration of a coupling portion of the cell phone case of FIG. 1 detached from the cell phone case along the 4-4 lines of FIG. 3.
Figure 3:
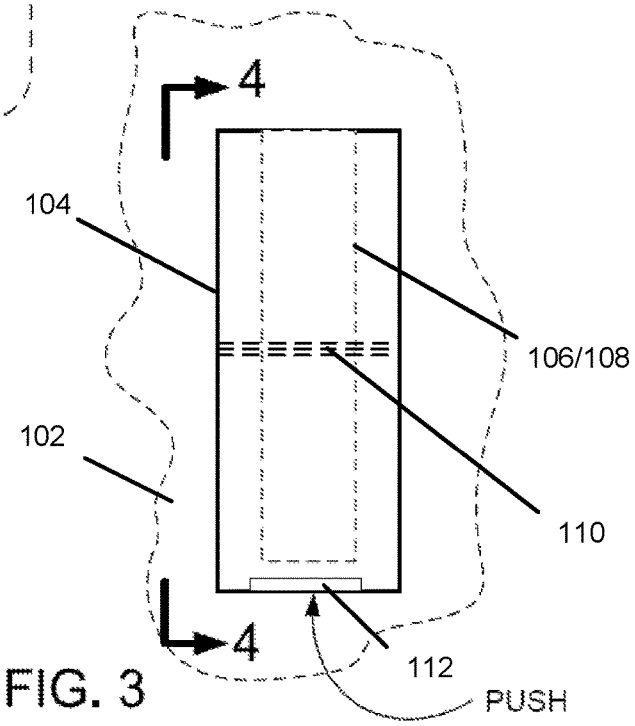
FIG. 3 is a plan view illustration of a coupling portion of the cell phone case of FIG. 1 detached from the cell phone case illustrating both the flexing area of the coupling portion as well as the release area thereof.
Figure 9:
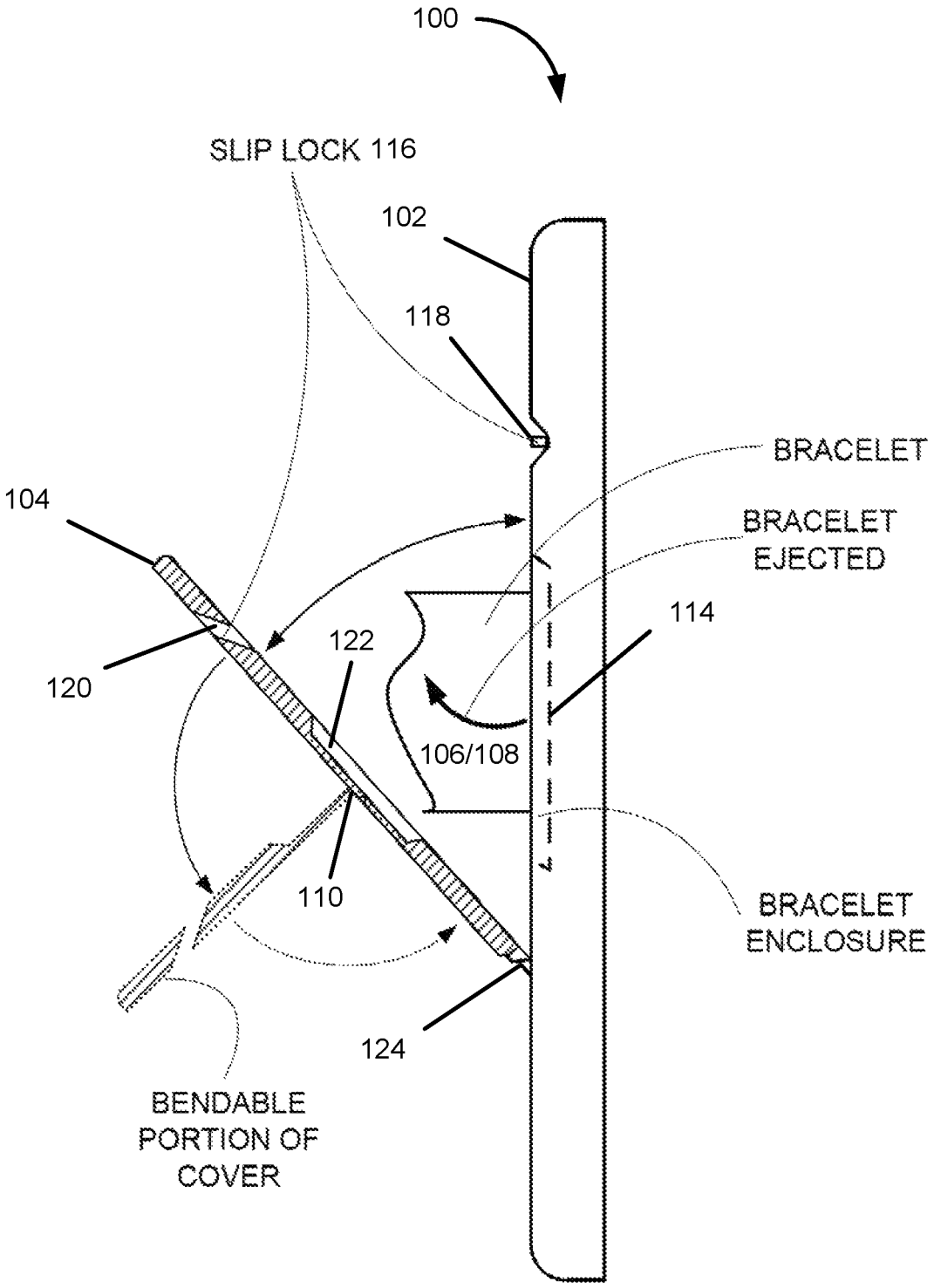
FIG. 9 is a side view illustration of a cell phone case according to one embodiment of the present invention illustration one method by which a bracelet element is engaged with and coupled to a cell phone according to the present invention via a coupling portion.

Turning to FIGS. 3 and 4, these Figures illustrate one method by which coupling portion 104 can be deformed in order to permit decoupling and/or disengagement from cell phone case 100 thereby permitting a partial part 106 of bracelet element 108 to either be placed within or removed from a depression, or cutout, 114 formed on the back side of phone case element 102 (see, e.g., FIGS. 2 and 9). In one embodiment, depression/cutout 114 can be sized such that coupling portion 104 is able to lie flush when in a closed position when a partial part 106 of bracelet element 108 is coupled to and/or engaged with phone case element 102. In another embodiment, coupling portion 104 can be designed to lie raised above the back surface of phone case element 102 when in a closed position so as to permit an increased amount of vertical spacing so that a bracelet element 108 having a thicker cross-sectional partial part 106 of can be used in conjunction with the cell phone case of the present invention. In still another alternative, coupling portion 104 can be designed to lie below the back surface of phone case element 102 when in a closed position so as to permit a decreased amount of vertical spacing so that a bracelet element 108 having a thinner cross-sectional partial part 106 can be used in conjunction with the cell phone case of the present invention.

As can be seen from FIGS. 3 and 4, a hinge 110 is formed in, for example, the middle of coupling portion 104 in order to permit some portion of coupling portion 104 to be bent or flexed so that a user can more easily couple/decouple a partial part 106 of bracelet element 108 from cell phone case 100. In one embodiment, release notch 112 can be utilized by a user to release and then bend or flex coupling portion 104 away from the back side of phone case element 102. This action permits a user to disengage from, or engage, a desired partial part 106 of bracelet element 108 with phone case element 102.

As can be seen from FIG. 9, in one embodiment, phone case element 102 further comprises a slip lock (or locking mechanism) 116 formed from a combination of a tab, or notch, 118 and an engagement channel 120 (in one embodiment engagement channel 120 can be an angled engagement channel), where engagement channel 120 and tab/notch 118 act together to permit the retention of coupling element 104 in a closed position. Additionally, as illustrated in FIG. 9, coupling element 104 can optionally include a depression, or cutout, 122 to permit an increased amount of vertical spacing so that a bracelet element 108 having a thicker cross-section can be used in conjunction with the cell phone case of the present invention. As is further illustrated in FIG. 9, coupling portion 104 can be flexibly attached to the back side of phone case element 102 by a hinge 124. As would be apparent to those of skill in the art, any other attachment method that permits attachment of coupling portion 104 to be flexibly attached to the back side of phone case element 102 can be utilized in conjunction with the present invention. Such methods include, but are not limited to, one or more clips or flanges (or even a plurality) that would permit coupling portion 104 to be snapped into and out of an appropriately sized depression/cutout on the back surface of phone case element 102. Alternatively, two slip locks similar to the one described about could be utilized to permit the retention of coupling portion 104 in, or on, the back surface of phone case element 102.

Figure 7:
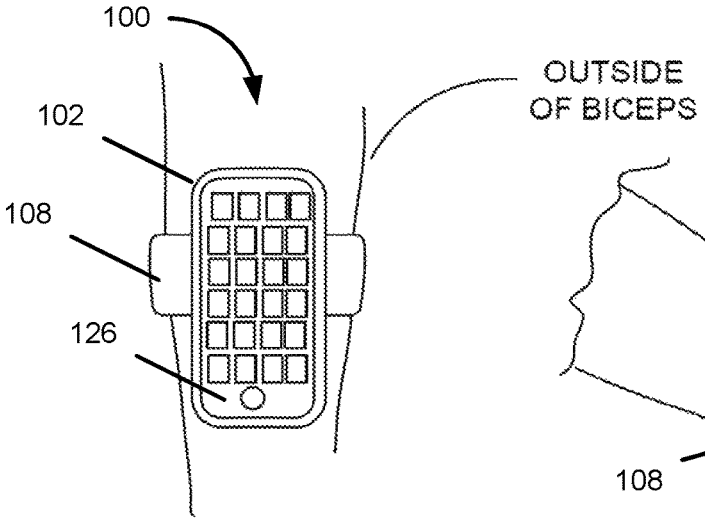
FIGS. 7 and 8 are illustrations of exemplary wearer positioning of a cell phone case according to one embodiment of the present invention.
Figure 8:
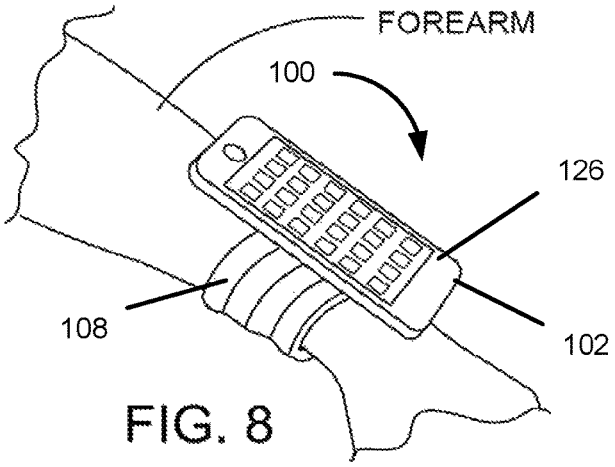

Turning to FIGS. 5 and 6, these Figures illustrate a side view (FIG. 5) and an end view (FIG. 6) of a cell phone case 100 in accordance with one embodiment of the present invention where bracelet element 108 is engaged and coupled to phone case element 102. Turning to FIGS. 7 and 8, these Figures illustrate one embodiment of the cell phone case 100 with a cell phone 126 inserted in an appropriately designed phone case element 102 of the present invention. Also illustrated in FIGS. 7 and 8, cell phone case 100 of the present invention is shown at various locations on a user's body. It should be noted that bracelet element 108 can be designed to permit the positioning of cell phone case 100 on a wide, non-limiting range of body parts, or locations, including, but not limited to, an arm, a forearm, an upper arm or bicep, a wrist, an ankle, a thigh, a calf, etc.

Turning to FIG. 9, FIG. 9 further illustrates one embodiment of the present invention where coupling portion 104 of the present invention is integrally formed in/on the backside of phone case element 102 of cell phone case 100 of the present invention and is comprised, in one embodiment, of at least two bendable portions where a first bendable joint, or hinge, 110 is formed in coupling portion 104 at approximately the middle thereof and a second fixed joint, or hinge, 124 is formed at one end thereof to permit the permit securing of one end of coupling portion 104 to phone case element 102.

As discussed above, cell phone case 100 of the present invention can optionally include locking mechanism 116, where locking mechanism 116 is designed to permit retention of coupling portion 104 of the present invention so that a partial part 106 of bracelet element 108 of the present invention can be securely engaged/coupled to cell phone case 100. The closing of coupling portion 104 permits bracelet element 108 and coupling portion 104 to together operatively couple to and engage phone case element 102 of cell phone case 100 of the present invention. As illustrated in FIG. 9, in one embodiment of the present invention locking mechanism 116 is a slip lock formed from an angled engagement channel 120 located in, at, or near the top of coupling portion 104 and a raised tab, or notch, 118 located on the backside of phone case element 102 of cell phone case 100 of the present invention. As would be apparent to those of skill in the art the slip lock configuration of locking mechanism 116 of FIG. 9 could be replaced by a tab on the backside of coupling portion 104 and a flexible latch formed on a portion of the backside of phone case element 102 above the edge of the closed coupling portion 104 so that such a flexible latch could fold over and securely engage the tab formed on the backside of coupling portion 104.

As noted above, when coupling portion 104 is open bracelet element 108 is able to be changed and/or removed from between the backside of phone case element 102 and the internally-facing side of coupling portion 104 of cell phone case 100 of the present invention. As is illustrated in FIG. 9 both a portion of the backside of phone case element 102 of cell phone case 100 of the present invention and an internal portion of the underside of coupling portion 104 of cell phone case 100 of the present invention each have a channel formed therein (a dashed trapezoidal shape 114 for the back of phone case element 102 and a non-hatched trapezoidal shape 122 in coupling portion 104). Alternatively, either one, or even both, of the channels or depressions for bracelet element 108 of the present invention need not be present in cell phone case 100 of the present invention. In this instance, bracelet element 108 of the present invention can be secured due to a sufficient amount of pressure generated by coupling, engaging or locking coupling portion 104 to the backside of phone case element 102 of cell phone case 100 (see, for example, FIGS. 1 and 2 where the coupling portion is in a closed position).

Given the above, one advantage of the present invention is that it permits the user to change the bracelet element associate with the overall cell phone case of the present invention. This in turn permits a user to mix and match the phone case element and coupling portions with different bracelet elements of the cell phone case of the present invention. The present invention also creates the possibility that third parties could chose to design and market bracelet elements that would be designed to work with the remaining elements of the present invention.

Although the invention has been described in detail with particular reference to certain embodiments detailed herein, other embodiments can achieve the same results. Variations and modifications of the present invention will be obvious to those skilled in the art and the present invention is intended to cover in the appended claims all such modifications and equivalents.

What is claimed is:

1. A cell phone case comprising:

a phone case element having front surface and a back surface;

a coupling portion, wherein the coupling portion is designed to couple to, or engage with, at least a portion of the back surface of the phone case element, the coupling portion having formed therein at least one centrally located hinge, the centrally located hinge being formed from at least one notch, channel or thinned portion located on at least one surface of the coupling portion; and a bracelet element, the bracelet element being sized for an adult wrist, wherein the phone case element and the coupling portion can be coupled to, or engaged with, one another in order to removably capture only a partial portion of the bracelet element when the cell phone case is in use.

2. The cell phone case of claim 1, wherein the phone case element of the coupling portion are integrally formed so as to be permanently affixed to one another.

3. The cell phone case of claim 1, wherein at least one of the back surface of the phone case element or an inner surface of the coupling portion has formed therein a bracelet channel or bracelet depression in order to permit a bracelet element having a thicker cross-section to be removably captured therein.

4. The cell phone case of claim 1, wherein both the back surface of the phone case element and an inner surface of the coupling portion have formed therein a bracelet channel or bracelet depression in order to permit a bracelet element having a thicker cross-section to be removably captured therein.

5. The cell phone case of claim 1, wherein one end of the coupling portion is permanently affixed to the back surface of the phone case element by a hinge.

6. The cell phone case of claim 1, wherein the coupling portion is removably affixed to the back surface of the phone case element by a plurality of clips or flanges.

7. The cell phone case of claim 1, wherein the hinge of the coupling portion permits the coupling portion to bend or flex.

8. The cell phone case of claim 1, wherein the cell phone case further comprises a locking mechanism formed in from a combination of a tab and an engagement channel.

9. The cell phone case of claim 1, wherein the cell phone case comprises two or more bracelet portions elements where each individual bracelet element can be interchangeably used in conjunction with the cell phone case.

10. A cell phone case comprising:

a phone case element having front surface and a back surface;

a coupling portion, wherein the coupling portion is designed to couple to, or engage with, at least a portion of the back surface of the phone case element, the coupling portion having formed therein at least one centrally located hinge, the centrally located hinge being formed from at least one notch, channel or thinned portion located on at least one surface of the coupling portion; and a bracelet element, the bracelet element being sized for an adult wrist, wherein the phone case element and the coupling portion can be coupled to, or engaged with, one another in order to removably capture only a partial portion of the bracelet element when the cell phone case is in use, wherein the at least one hinge permits the coupling portion to bend or flex, and wherein the phone case element and the coupling portion are integrally formed so as to be permanently affixed to one another.

11. The cell phone case of claim 10, wherein at least one of the back surface of the phone case element or an inner surface of the coupling portion has formed therein a bracelet channel or bracelet depression in order to permit a bracelet element having a thicker cross-section to be removably captured therein.

12. The cell phone case of claim 10, wherein both the back surface of the phone case element and an inner surface of the coupling portion have formed therein a bracelet channel or bracelet depression in order to permit a bracelet element having a thicker cross-section to be removably captured therein.

13. The cell phone case of claim 10, wherein one end of the coupling portion is permanently affixed to the back surface of the phone case element by a hinge.

14. The cell phone case of claim 10, wherein the cell phone case further comprises a locking mechanism formed in from a combination of a tab and an engagement channel.

15. The cell phone case of claim 10, wherein the cell phone case comprises two or more bracelet portions elements where each individual bracelet element can be interchangeably used in conjunction with the cell phone case.

* * * * *